United States Patent [19]

Howard et al.

[11] Patent Number: 4,706,400

[45] Date of Patent: Nov. 17, 1987

[54] UNIVERSAL SIGN BRACKET

[76] Inventors: Edward J. Howard, 2567 Broadway, Toledo, Ohio 43609; Edward J. Howard, Sr., 4244 River Rd., Toledo, Ohio 43614

[21] Appl. No.: 865,461

[22] Filed: May 21, 1986

[51] Int. Cl.[4] ..... G09F 7/22

[52] U.S. Cl. ..... 40/617; 40/607; 40/611

[58] Field of Search ..... 52/822, 830, 783, 784; 248/218.4, 219.4, 916, 300; 40/606, 607, 611, 617

[56] References Cited

U.S. PATENT DOCUMENTS

| | | | |
|---|---|---|---|
| 1,768,731 | 7/1930 | Awbrey | 52/784 |
| 1,854,145 | 4/1932 | Wright | 40/617 |
| 1,902,769 | 3/1933 | Esdorn | 52/38 |
| 2,383,881 | 8/1945 | Murphy | 40/607 |
| 2,559,106 | 7/1951 | Bishop | 40/606 |
| 2,705,820 | 4/1955 | Torrence | 52/822 |
| 3,590,754 | 7/1971 | Jakobsen | 52/784 |
| 4,209,928 | 7/1980 | Kraayvanger | 40/617 |
| 4,441,300 | 4/1984 | Varon | 52/732 |

FOREIGN PATENT DOCUMENTS

| | | | |
|---|---|---|---|
| 413502 | 12/1966 | Switzerland | 40/607 |

*Primary Examiner*—Henry E. Raduazo

*Attorney, Agent, or Firm*—Allen D. Gutchess, Jr.

[57] ABSTRACT

A universal sign bracket is provided which can be cut to size and bent or even twisted to accommodate signs of various shapes and sizes. The bracket comprises a main leg and an intermediate flange extending generally perpendicular from an intermediate portion of the main leg. The intermediate flange can have spaced slots adjacent the main leg to receive mounting straps for mounting the bracket on a pole. The main leg can also have spaced openings to receive fasteners for mounting the bracket on poles and other supports. The main leg has a longitudinally-extending groove adjacent the intermediate flange to receive an edge of a sign panel with the sign panel than serving as a supporting gusset for the bracket when affixed by fasteners extending through the intermediate flange. The main leg also preferably has two spaced ribs along edge portions on the side opposite the flange to cooperate with supporting posts.

17 Claims, 7 Drawing Figures

UNIVERSAL SIGN BRACKET

This invention relates to a universal sign bracket for signs of various shapes and sizes.

The universal sign bracket comprises an elongate rigid member of generally T-shaped transverse cross section with a main or base leg and an intermediate flange extending generally perpendicular from an intermediate portion of the main leg. The main leg has a shallow groove extending longitudinally thereof adjacent the intermediate flange to receive edges of a sign panel to be supported so that the sign panel, when fastened to the flange, serves as a gusset to provide further strength and stiffness for the bracket. The main leg also has longitudinally extending ribs on the side opposite the flange which are mirror images as viewed from an end of the bracket. These ribs, have outwardly-facing, concave sides which enable the bracket to be mounted more securely on a U-shaped supporting post, either on the wide side or the narrow side of the post. The intermediate flange can have longitudinally spaced slots preferably located adjacent the main leg to receive mounting straps for mounting the bracket on a pole. The main leg can also have spaced openings to receive fasteners to mount the bracket on almost any type of support. The elongate member can be bent at various angles to receive sign panels of various shapes and can be even twisted so as to be mounted on the back of a sign panel. Further, for larger signs, two of the brackets can be employed therewith. The intermediate flange can have suitable holes drilled therealong for receiving fasteners to mount the sign panel on the flange. The intermediate flange can also have a V-shaped groove extending longitudinally thereof to receive a drill bit for positioning the bit to properly drill the holes in the flange.

The sign bracket according to the invention can be made of aluminum for durability and relatively easy fabrication for particular signs and installations. The sign bracket can be formed as an extrusion in long lengths and then cut to length for specific requirements.

It is, therefore, a principal object of the invention to provide a universal sign bracket having the adaptability, features, and advantages set forth above.

Many other objects and advantages of the invention will be apparent from the following detailed description of preferred embodiments thereof, reference being made to the accompanying drawings, in which.

Figure 1:
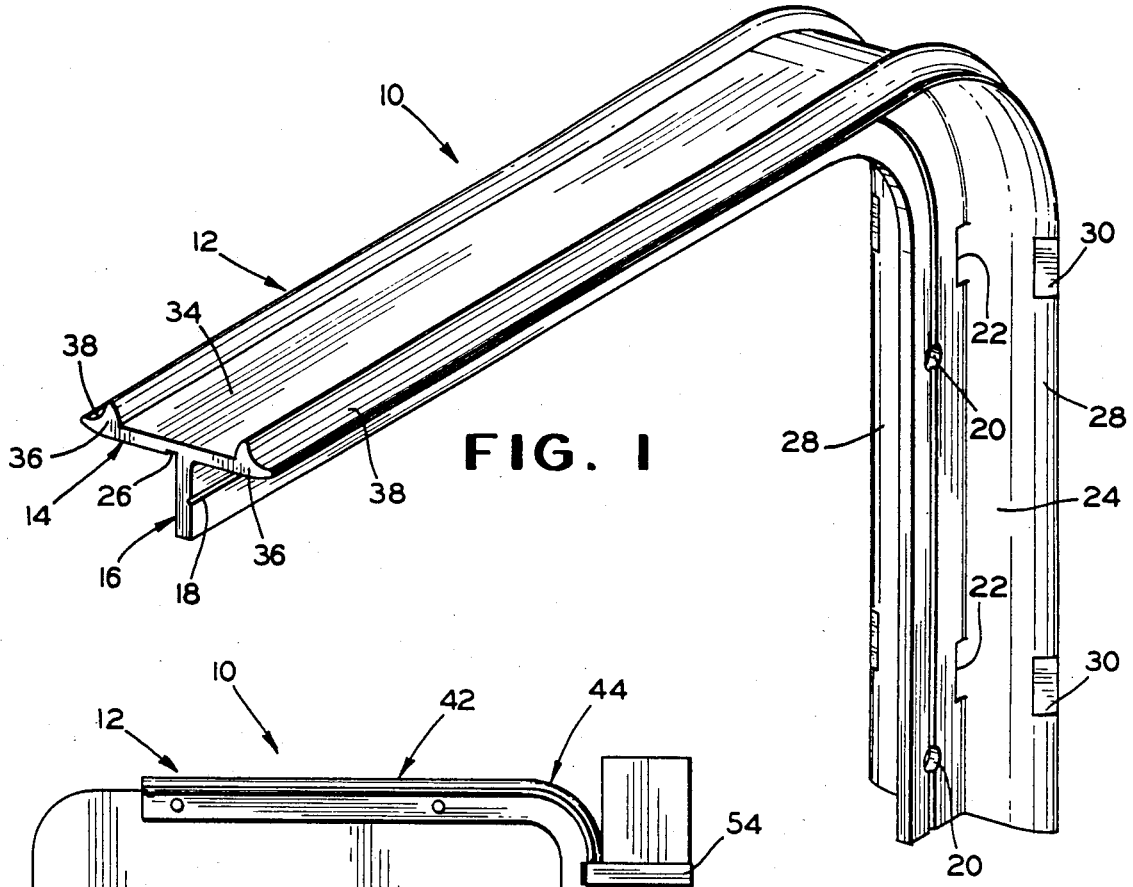
FIG. 1 is a view in perspective of a sign bracket in accordance with the invention.

Referring to the drawings and particularly to FIG. 1, a sign bracket in accordance with the invention is indicated at 10 and comprises an elongate rigid member 12 which can be made of extruded metal, particularly aluminum, in a long length and subsequently cut to shorter lengths according to the sign panel to be supported. The elongate member comprises a main or base leg 14 and an intermediate flange 16 extending generally perpendicularly from an intermediate portion of the base leg 14 to form a generally T-shaped transverse cross section for the member 12. The flange 16 has a width from about one-third to about one-half the width of the base leg 14, in a preferred form. A longitudinally-extending V-shaped groove 18 is formed in one side of the flange 16 at an intermediate point from one-half to two-thirds of the width of the flange 16 from the base leg 14. The V-shaped groove 18 provides a guide for a drill bit by means of which fastener-receiving openings 20 are formed in the flange 16 at selected longitudinal positions. Slots 22 can also be formed at the base of the flange 16 adjacent the base leg 14 to receive mounting straps. Edge portions of the sign panel can also be notched to receive the straps adjacent the slots 22, if desired.

A front surface 24 of the base leg 14 has a center, longitudinally-extending shallow groove 26 therein with the flange 16 being slightly offset from center and contiguous with the groove 26. The groove 26 is designed to receive edges of a sign panel when fastened to the flange 16, thereby to aid in preventing portions of the sign panel between the fastener-receiving openings 20 from buckling outwardly if a compressive force is placed on the bracket.

Outer edges 28 of the base leg 14 are rounded to enable mounting straps to fit more snugly therewith and the edges 28 also can have notches 30 transversely aligned with the slots 22 to even more snugly receive mounting straps which are wrapped around a pole. When fasteners are employed to mount the bracket 10, suitable fastener-receiving openings 32 (FIGS. 3 and 4) can be drilled in the base leg 14 adjacent the groove 26 at suitable spaced intervals.

A back surface 34 of the base leg 14 has edge ribs 36 extending longitudinally thereof which are mirror images of one another as viewed from an end of the bracket 10. The ribs 36 have concave sides 38, the purpose of which will be discussed subsequently.

Figure 2:
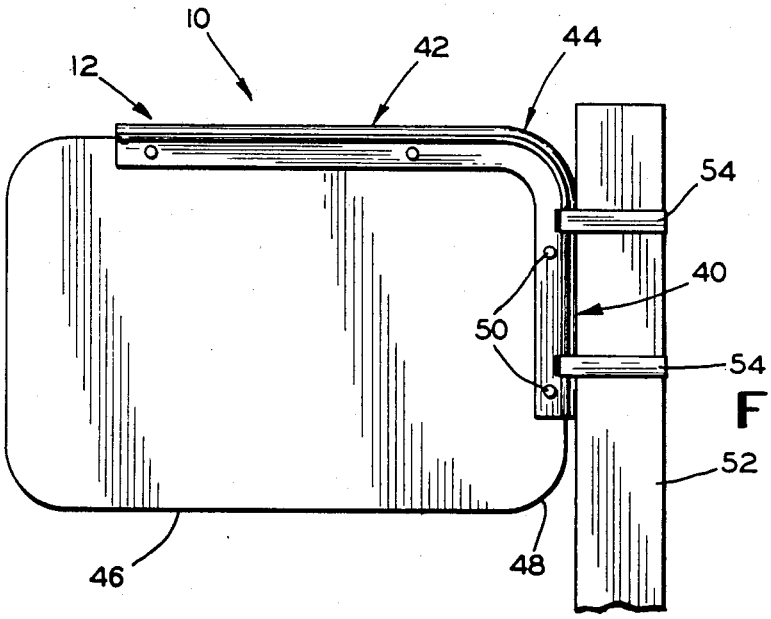
FIG. 2 is a side view in elevation of the sign bracket and a sign panel, the bracket being mounted on a pole by mounting straps.

The elongate member 12 is usually bent to form two straight portions, such as portions 40 and 42 of FIG. 2, with a short curved portion 44 therebetween. The portions 40 and 42 are at right angles when a sign panel 46 is of a generally rectangular shape. The panel 46 has rounded corners 48 to fit closely with the curved portion 44 of the elongate member 12. The edges of the panel are received in the shallow groove 26 of the base leg 14 and suitable fasteners 50 such as rivets or bolts extend through the holes 20 in the flange 16 and through suitable holes formed or punched in the edge portions of the sign panel 46. The close cooperation between the sign panel 46 and the bracket 10 enables the panel 46 to serve as a gusset and provide stiffness and strength to resist bending if, for example, a youngster attempts to hang on the straight portion 42. The sign panel 46 itself can be made of aluminum, fiber-reinforced plastic, or other plastic materials.

The bracket 10 of FIG. 2 is mounted on a supporting pole 52 by mounting straps 54 extending therearound. The straps 54 extend through the slots 22 in the flange 16 and are received in the notches 30 so as to fit more closely with the pole 52 and reduce the possibility of the bracket being twisted on the pole. The ribs 36 also aid in nesting the bracket on the pole 52. The straps 54 are tightened by a suitable tool, as is well known in the art.

Figure 3:
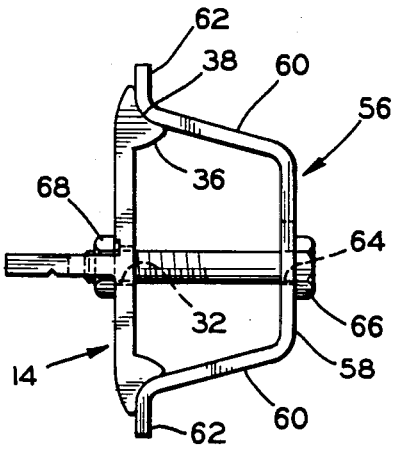
FIG. 3 is a view in transverse section of the sign bracket mounted in one position on a U-shaped supporting post.
Figure 4:
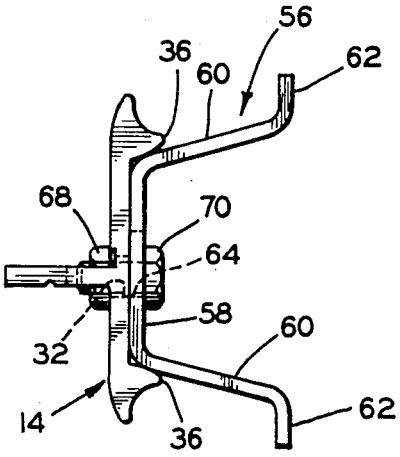
FIG. 4 is a view similar to FIG. 3 but with the sign bracket mounted in another position on the U-shaped post.

The design of the elongate member 12 is also ideally suited for mounting the bracket 10 on a generally U-shaped sign supporting post 56, as shown in FIGS. 3 and 4. These posts 56 are commonly used to support parking signs, stop signs, and the like and are generally of the same size and shape in transverse cross section. The posts commonly have a central web 58 with flaring legs 60 terminating in flanges 62. Uniformly spaced holes 64 are located longitudinally of the web 58 and centrally located therein. The elongate member 12 can be mounted on the outer edges of the flaring legs 60 with concave sides 38 of the ribs 36 nesting smoothly therewith. The member 14 can then be held in place by bolts 66 extending through the holes 32 in the base leg 14 and the holes 64 in the web 58, being secured by nuts 68. The elongate member 14 can also be secured to a narrow side of the post 56 on the web 58, as shown in FIG. 4. The spacing between the ribs 36 approximately equals the width of the web 58 so that the elongate member 14 can nest with the post 56 when a shorter bolt 70 extends through the holes 32 and 64 to receive the nut 58. Deeper slots 22 can also be punched in the flange 16 to receive the nuts 68 and the ends of the bolts 66.

Figure 5:
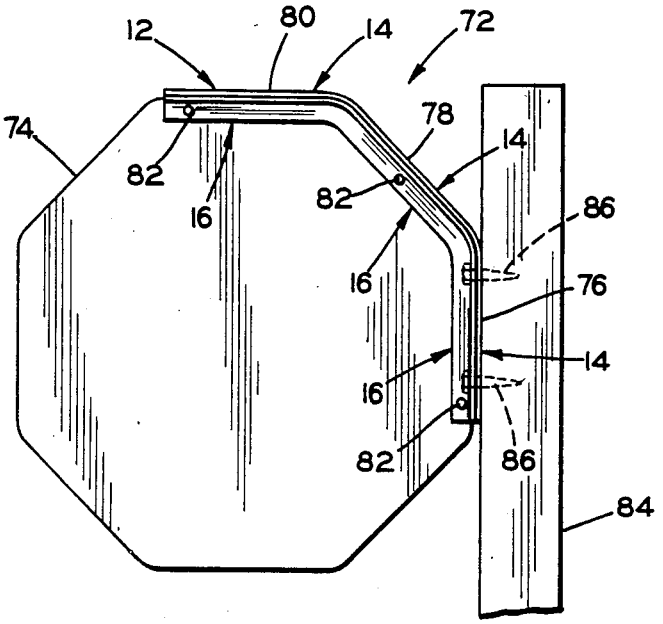
FIG. 5 is a view in elevation of a modified sign bracket and sign panel.

Referring to FIG. 5, a modified sign bracket 72 is employed with a modified sign panel 74 having eight sides, in this instance. The sign bracket 72 has three straight portions 76, 78, and 80 to receive three edge portions of the panel 74 which are affixed to the flanges 16 of the straight portions by fasteners 82. In this instance, the straight portion 76 of the bracket 72 is affixed to a wooden supporting post 84 by fasteners 86 extending through the holes 32 of the base leg 14.

Figure 6:
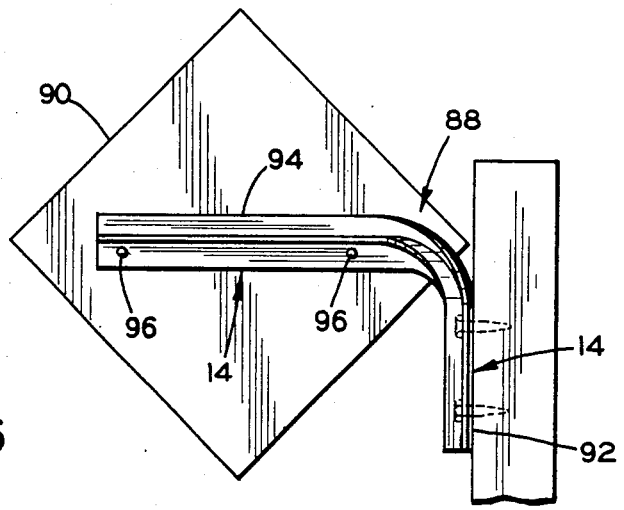
FIG. 6 is a view in elevation of another modified sign bracket and sign panel.

Referring to FIG. 6, a modified sign bracket 88 is used to support the back of a sign panel 90. In this instance, the bracket 88 has a downwardly-extending straight portion 92 and a horizontally-extending straight portion 94 which is bent at right angles with respect to the straight portion 92 and twisted ninety degrees to place the flanges 16 in planes at mutually perpendicular angles. Suitable fasteners 96 are then used to affix the straight portion 94 to the back of the sign panel 90.

Figure 7:
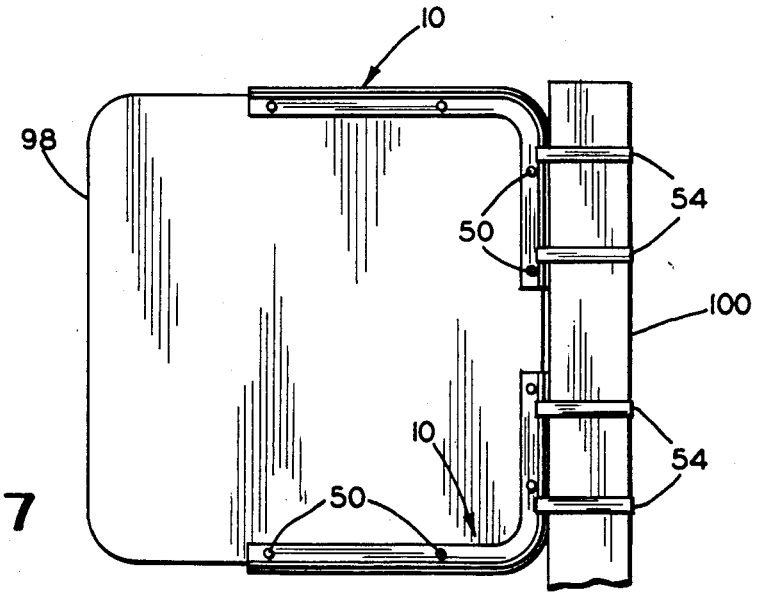
FIG. 7 is a view in elevation of two sign brackets and a larger sign panel.

Referring to FIG. 7, for larger signs, two of the brackets 10 can be employed with a large sign panel 98. The brackets are secured to the panel 98 by the fasteners 50 and the brackets 10 are secured to a pole 100 by the straps 54. It is also possible to have a single bracket which extends around all of the top and bottom edge portions and one side edge portion of the sign panel 98.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A sign bracket adapted to be affixed to supports of different types, including a post of generally U-shaped cross section having a central web and flaring legs, said sign bracket comprising an elongate rigid member of generally T-shaped transverse cross section with a main leg and an intermediate flange extending generally perpendicularly from an intermediate portion of said main leg, said main leg having two spaced, narrow ribs along edge portions on the side opposite said intermediate flange, said ribs being mirror images as viewed from an end of the bracket, said ribs having inner surfaces facing one another which are spaced apart a distance not less than the width of the central web, and said ribs having outer surfaces facing away from one another which are spaced apart a distance not exceeding the distance between outer edges of said flaring legs.

2. A sign bracket according to claim 1 characterized by said main leg having a narrow, longitudinally-extending groove adjacent said intermediate flange to receive an edge portion of a sign panel.

3. A sign bracket according to claim 1 characterized by the outer surfaces of said ribs being concave to nest smoothly with outer edge portions of inner surfaces of the flaring legs.

4. A sign bracket according to claim 1 characterized by said intermediate flange having spaced slots adjacent the main legs to receive mounting straps.

5. A sign bracket according to claim 4 characterized by said main leg having edge notches thereon transversely aligned with said spaced slots to receive the mounting straps.

6. A sign according to claim 1 characterized by said second straight portion being twisted ninety degrees with respect to said first straight portion with the flange of said second straight portion being in a plane perpendicular to the plane of the flange of said first straight portion.

7. In combination, a sign bracket, a post of generally U-shaped cross section having a central web and flaring legs, said central web having a plurality of openings centrally located and uniformly spaced therealong, said sign bracket comprising an elongate rigid member of generally T-shaped transverse cross section with a main leg and an intermediate flange extending generally perpendicularly from an intermediate portion of said main leg, said main leg having two spaced, narrow ribs along edge portions on the side opposite said intermediate flange, said ribs being mirror images as viewed from an end of the bracket, said ribs being spaced apart such that they straddle said central web when said bracket is positioned on the web side of said post, and said ribs nest within said flaring legs when said bracket is placed on the opposite side of said post, said main leg having a plurality of fastener-receiving openings therealong on one side of said intermediate flange, and at least one fastener extending through one of said central web openings and through one of said main leg openings for fastening said bracket in fixed relationship with respect to said post.

8. The combination according to claim 7 characterized by said main leg having a narrow, longitudinally-extending groove adjacent said intermediate flange to receive an edge portion of a sign panel.

9. The combination according to claim 7 characterized by the outer surfaces of said ribs being concave to nest smoothly with outer edge portions of inner surfaces of said flaring legs.

10. The combination according to claim 7 characterized by said elongate rigid member having a first straight portion and a second straight portion extending at an angle to said first straight portion, said main leg being continuous and common to both of said straight portions and said intermediate flange being continuous and common to both of said straight portions, said intermediate flange being of the same width throughout its length, and said intermediate flange having a plurality of openings spaced therealong to receive fasteners for fastening a sign panel to said intermediate flange.

11. A sign bracket comprising an elongate rigid member having a first straight portion and a second straight portion extending at an angle to said first straight portion, each of said portions being generally T-shaped in transverse cross section with a common, continuous main leg and a common, single continuous intermediate flange extending generally perpendicularly from an intermediate portion of said main leg, and being offset to one side of the center of said main leg, said intermediate flange being of the same width throughout its length, said main leg having a continuous longitudinally-extending groove adjacent said single intermediate flange at the center of said main leg, said intermediate flange having spaced slots adjacent said main leg to receive straps for fastening the bracket to a support, said intermediate flange also having spaced fastener-receiving openings to affix a sign panel to the bracket, and a sign panel having a first straight edge portion and a second straight edge portion extending at an angle to the first straight edge portion, said edge portions of said panel extending into said longitudinally-extending groove, and fasteners extending through said fastener-receiving openings and through edge portions of said sign panel to affix said sign panel to said flanges.

12. A sign according to claim 11 characterized by the angle between said first straight portion and said second straight portion equaling the angle between said first straight edge portion and said second straight edge portion.

13. A sign according to claim 12 characterized by said angles being substantially equal to ninety degrees.

14. A sign according to claim 11 characterized by said elongate rigid member having a third straight portion extending at an angle to said second straight portion.

15. A sign bracket according to claim 11 characterized by said intermediate flange having spaced slots adjacent the main legs to receive mounting straps.

16. A sign bracket according to claim 15 characterized by said main leg having edge notches thereon transversely aligned with said spaced slots to receive the mounting straps.

17. A sign according to claim 11 characterized by said second straight portion being twisted ninety degrees with respect to said first straight portion with the flange of said second straight portion being in a plane perpendicular to the plane of the flange of said first straight portion.

* * * * *